US005970447A

United States Patent [19]

Ireton

[11] Patent Number: 5,970,447

[45] Date of Patent: Oct. 19, 1999

[54] DETECTION OF TONAL SIGNALS

[75] Inventor: Mark A. Ireton, Austin, Tex.

[73] Assignee: Advanced Micro Devices, Inc., Sunnyvale, Calif.

[21] Appl. No.: 09/008,967

[22] Filed: Jan. 20, 1998

[51] Int. Cl.[6] ..... G10L 9/12

[52] U.S. Cl. ..... 704/233; 704/213; 704/275

[58] Field of Search ..... 704/233, 275, 704/213

[56] References Cited

U.S. PATENT DOCUMENTS

| | | | |
|---|---|---|---|
| 4,937,869 | 6/1990 | Iwahashi et al. | 704/254 |
| 5,152,007 | 9/1992 | Uribe | 455/116 |
| 5,159,638 | 10/1992 | Naito et al. | 704/213 |
| 5,293,588 | 3/1994 | Satoh et al. | 704/233 |
| 5,305,422 | 4/1994 | Junqua | 704/253 |
| 5,459,814 | 10/1995 | Gupta et al. | 704/233 |
| 5,649,055 | 7/1997 | Gupta et al. | 704/233 |
| 5,692,104 | 11/1997 | Chow et al. | 704/253 |
| 5,774,849 | 6/1998 | Benyassine et al. | 704/246 |

*Primary Examiner*—David R. Hudspeth
*Assistant Examiner*—Tálivaldis Ivars Šmits
*Attorney, Agent, or Firm*—Conley, Rose & Tayon; Jeffrey C. Hood; Mark Brightwell

[57] ABSTRACT

The system and method of the present invention uses a zero-crossing rate measurement in order to determine the initiation and/or termination of speech in an audio signal input. It is especially well suited for detecting the termination of a telephone message in a telephone answering device. Specifically, a sample of the zero-crossing rate signal is determined by counting the number of consecutive speech samples required for the occurrence of a pre-defined number of consecutive zero-crossings. The resultant zero-crossing rate signal is smoothed and applied to a differentiator. A short-time magnitude integration is performed to measure the energy in the differentiated signal. The output of the magnitude integration is provided to a threshold detector which produces a sequence of decision values indicating the presence or absence of speech. Finally, the decision values are filtered to produce a more definitive sequence of final decision values.

22 Claims, 5 Drawing Sheets

DETECTION OF TONAL SIGNALS

FIELD OF THE INVENTION

The present invention relates generally to the field of speech detection, and more specifically to an improved system and method for detecting initiation and/or termination of a speech message in a voice storage device or telephone answering device.

DESCRIPTION OF THE RELATED ART

Telephone answering machines are a fundamental artifact of the modem life-style. A fundamental problem connected with answering machine performance is that of detecting the end of a message. Since the answering machine employs a finite storage media (tape or RAM), to record in-coming speech messages, it is essential that the answering machine be able to accurately detect the end of these messages. The end of a message can occur in many ways, but the result is nearly always some form of tonal sequence (i.e. sequence of tones) or background noise (silence). For the sake of discussion, this end of message signal, which ensues upon the conclusion of the speech signal, will be called the termination signal. It is simple to distinguish silence from speech by the use of a simple energy measure. Background noise usually has much smaller power, and thus energy, than a speech signal. However, tonal signals, which represent the most typical termination signal, contain high energy. Thus the energy measure fails as a general technique for distinguishing speech from termination signals.

The problem of detecting the end of a message is compounded by the fact that the nature of the tones is best assumed to be unknown. Dial tone is the most common result, but this varies from country to country, and may even vary across private branch exchanges (PBX's). Other signals may also occur which may have an on-off cadence, and which may contain a variety of frequencies.

It should be noted that the problem of detecting the termination of speech in an answering machine message is part of the more general problem of detecting the initiation and termination (i.e. the endpoints) of speech in a noise environment. One prior art endpoint detection system employs zero-crossing rate (ZCR) and short-time energy measurements with statistically determined detection thresholds [Rabiner and Schafer, *Digital Processing of Speech Signals*, pages 130–133, published by Prentice-Hall, ISBN 0-13-213603-1, TK7882.S65R3]. In particular, Rabiner & Schafer disclose an algorithm for detecting the endpoints of an isolated speech utterance which involves computing a zero-crossing rate signal and an average magnitude signal based on the signal of interest. The zero-crossing rate signal is calculated using a moving window with 10 millisecond time-width: the number of zero-crossings in a 10 millisecond window is reported as a measure of the local zero-crossing rate. Similarly the average magnitude signal is calculated using a moving window with a 10 millisecond time-width: a weighted sum of the magnitudes (absolute values) of samples in a window is reported as a measure of local energy.

The zero-crossing rate and average magnitude signals are assumed to contain no speech content during an initial training period. The zero-crossing rate signal and average magnitude signal samples during this training period are subjected to a statistical analysis to determine two different average magnitude thresholds and one zero-crossing rate threshold. The algorithm uses the two average magnitude thresholds and the zero-crossing rate threshold to determine the endpoints of a speech utterance in the signal of interest.

The algorithm operates as follows. First, the average magnitude signal is searched to determine a maximal interval [A,B] with the property that the average magnitude signal exceeds the larger magnitude threshold everywhere on the interval. Second, the endpoints of the maximal interval are extended outward to points where the average magnitude signal falls below the smaller magnitude threshold, defining interval [C,D]. Third, the zero-crossing rate signal is consulted to possibly extend the endpoints even further. Namely, in the zero-crossing rate signal, the 25 samples immediately to the left of (preceding) C are searched. If the zero-crossing rate signal exceeds the zero-crossing rate threshold three or more times in the 25 samples, the start point C is moved to the location of the first such exceeding. Similarly, the furnish point D is conditionally moved to the right.

Thus, the algorithm disclosed by Rabiner & Schafer apparently uses the observation that speech is associated with higher zero-crossing rate and higher average magnitude (or energy) than background noise. Thus the algorithm of Rabiner & Schafer is unlikely to perform adequately in situations where the background noise has power and zero-crossing rate comparable to that of the speech signal. Thus a system and method are needed whereby the initiation and/or termination of a speech signal may be detected in a noise environment where the noise is not necessarily of low zero-crossing rate or low energy. In particular, a system and method are needed whereby the termination of speech may be detected in a telephone message.

SUMMARY OF THE INVENTION

The system and method of the present invention uses a zero-crossing rate measurement in order to determine the initiation and/or termination of speech in an audio signal input. The present invention is especially well suited for detecting the termination of a telephone message in a telephone answering device. Specifically, a sample of the zero-crossing rate signal is determined (a) by counting the number of consecutive speech samples required for the occurrence of a pre-defined number of consecutive zero-crossings, or (b) by counting the number of zero-crossings occurring in a pre-defined number of consecutive speech samples. The former calculation gives a zero-crossing period and the later gives a zero-crossing rate. However the distinction is not significant to the present invention. The resultant zero-crossing rate signal is smoothed and applied to a differentiator. An energy signal is then produced from the differentiated signal, by measuring the energy in the differentiated signal over a moving window in time. This energy measurement captures the amount of variation of the zero-crossing rate signal. A short-time magnitude integration is performed to measure the energy in the differentiated signal.

Speech has a time-varying spectrum and hence also a time-varying zero-crossing rate. Hence, while speech energy is present in the audio input, the energy measurements should report large values. In contrast, the non-speech signal which ensues at the end of a telephone call after speech has terminated is a mixture of tones, multi-tones, and Gaussian noise, having a locally constant spectrum and thereby a locally constant zero-crossing rate. Thus, when the speech signal is absent, the energy measurements should report small values. By applying the energy measurements to a threshold detection device, the present invention produces a sequence of decision values indicating the presence or absence of speech.

Furthermore, the present invention preferably includes filtering the sequence of decision values. By examining a moving-window of K consecutive decision values, a sequence of "final" decision values may be asserted. Namely, in each window the decision values which indicate the presence of speech are counted. When the count exceeds a first threshold J, then a final decision is asserted indicating the presence of speech. Conversely, when the count is smaller than a second threshold I, a final decision is asserted indicating the absence of speech.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1A:
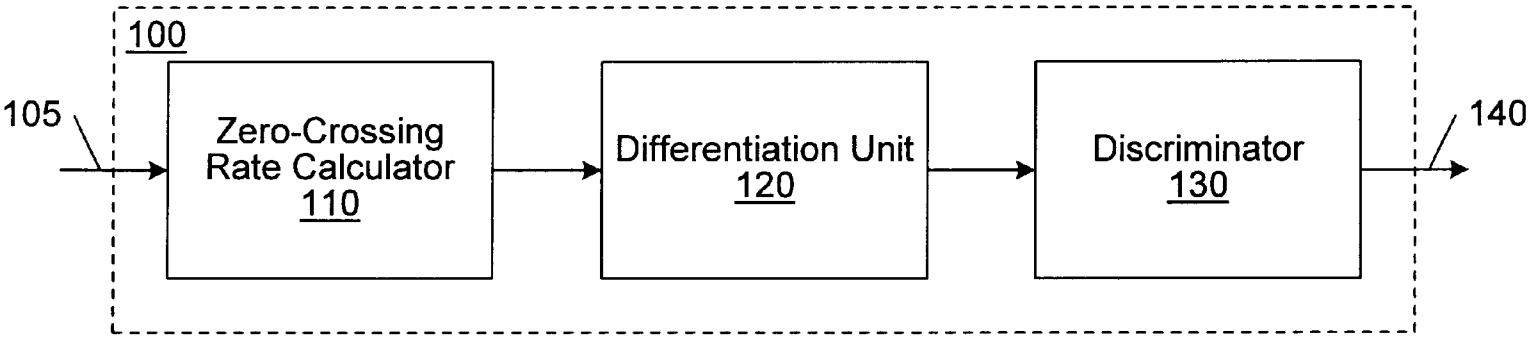
FIG. 1A is a block diagram of a speech signal detector 100 according to the present invention.

Referring now to FIG. 1A, a block diagram of a speech signal detector 100 according to the preferred embodiment of the present invention is shown. The speech signal detector 100 comprises an input 105, a zero-crossing rate calculator 110, a differentiation unit 120, a discriminator 130, and an output 140. The zero-crossing rate calculator 110 is coupled to input 105. The zero-crossing rate calculator 110 is also coupled to the differentiation unit 120. The differentiation unit 120 is coupled to the discriminator 130. And the discriminator 130 is coupled to the output 140.

An input signal is supplied to the speech signal detector 100 through input 105. In the preferred embodiment of the invention, the input signal is a digitized telephone signal. The zero-crossing rate calculator operates on the input signal to produce a zero-crossing rate signal. A sample of the zero-crossing rate signal provides a measure of local zero-crossing rate in the input signal. The zero-crossing rate signal is provided to differentiation unit 120. The differentiation unit 120 uses the zero-crossing rate signal to calculate a differentiated zero-crossing rate signal. The differentiated zero-crossing rate signal measures the variation (or rate of change) of the zero-crossing rate signal. The differentiated zero-crossing rate signal is supplied to the discriminator 130. The discriminator 130 uses the differentiated zero-crossing rate signal to determine the instantaneous presence or absence of speech in the input signal. An output signal, reflecting the instantaneous presence or absence of speech in the input signal, is provided by discriminator 130 via output 140.

Figure 2:
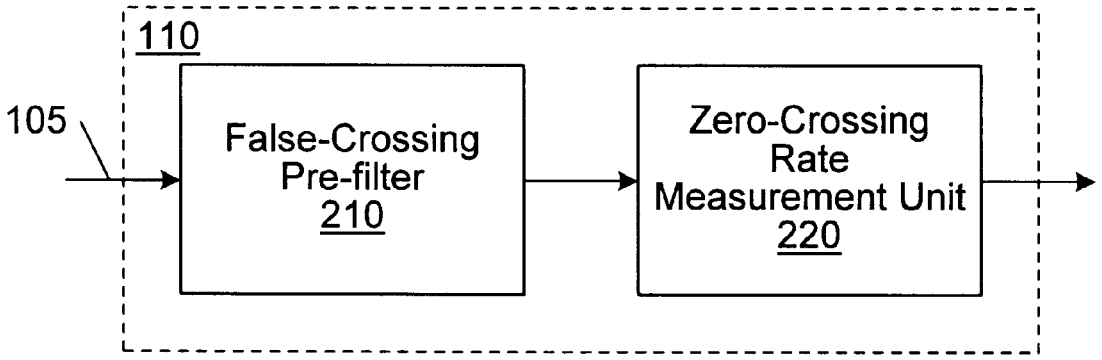
FIG. 2 is a block diagram of the zero-crossing rate calculator 110 according to the present invention.

Referring now to FIG. 2, a block diagram of the zero-crossing rate calculator 110 according to the present invention is shown. The zero-crossing rate calculator 110 operates on the input signal to produce a zero-crossing rate signal. The zero-crossing rate calculator 110 comprises a false-crossing pre-filter 210 and a zero-crossing rate measurement unit 220. The false-crossing pre-filter 210 is coupled to the input 105. Also the false-crossing pre-filter 210 is coupled to the zero-crossing rate measurement unit 220. The zero-crossing rate measurement unit 220 has an output which is coupled to the differentiation unit 110.

The false-crossing pre-filter 210 receives the input signal via the input 105, and serves to map low amplitude input samples to zero. This pre-filtering eliminates spurious zero-crossings due to noise, especially during the low level part of a dual tone beat. The false-crossing pre-filter 210 operates on each input sample to produce an output sample according to the follow rule: if the absolute value of an input sample is smaller than a fixed threshold, the output sample is set to zero, else the output sample is equal to the input sample. The output signal thereby produced is referred to the modified input signal.

The zero-crossing rate measurement unit 220 receives the modified input signal from the false-crossing pre-filter 210 and produces a zero-crossing rate signal. The zero-crossing rate signal comprises a sequence of ZCR samples. A ZCR sample is calculated by counting the number of samples required for the occurrence of L successive zero-crossings in the input signal, where L is a system defined constant. Thus a ZCR sample actually measures the local zero-crossing period. However the distinction between zero-crossing rate and period is not significant for the present invention. In an essentially equivalent embodiment of the invention, a ZCR sample is calculated by counting the number of zero-crossings which occur in a window of M successive samples of the input signal, where M is a system defined constant.

Figure 1B:
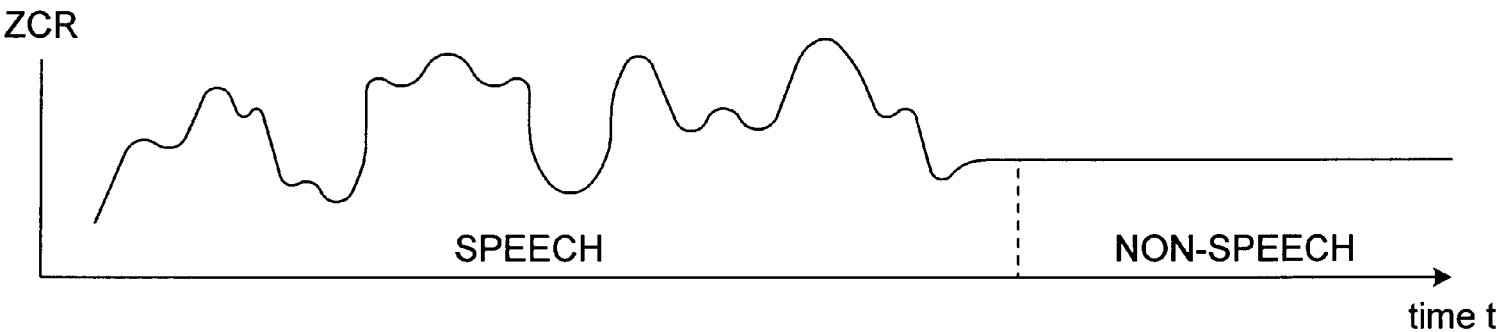
FIG. 1B provides a motivation of the present invention by means of a zero-crossing rate signal depicted during a transition from speech to non-speech.

Referring now to FIG. 1B, a motivation of the present invention is provided by means of a zero-crossing rate signal depicted during a transition from speech to non-speech. Notice that speech is associated with a time-varying zero-crossing rate (ZCR), while the tonal signals and/or noise, which occur after the speech message, have relatively constant zero-crossing rate. By performing a differentiation operation, the intrinsic variation (rate of change) of the zero-crossing rate signal is exposed. Furthermore, by performing a moving-window integration of the absolute value (magnitude) of the differentiated signal, the variation in the zero-crossing rate is monitored on a continuous basis. A large value for the magnitude integration indicates the presence of speech, and a small value indicates the absence of speech.

Figure 3:
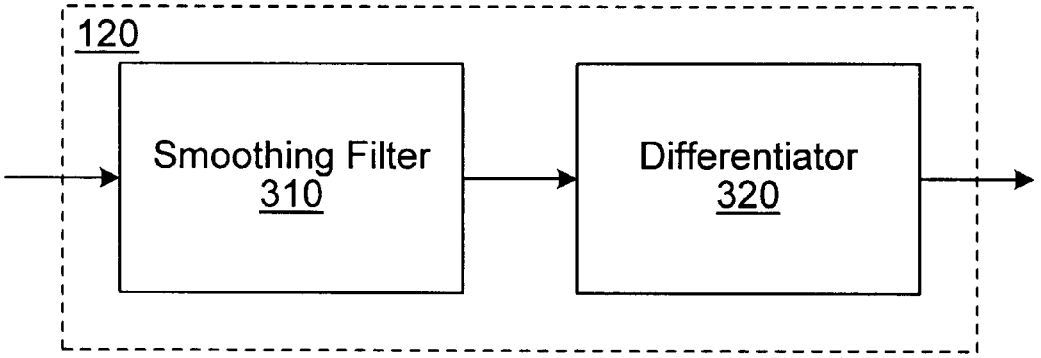
FIG. 3 is a block diagram of the differentiation unit 120 according to the present invention.

Referring now to FIG. 3, a block diagram of the differentiation unit 120 according to the present invention is presented. The differentiation unit 120 uses the zero-crossing rate signal received from the zero-crossing rate calculator 110 to calculate a differentiated zero-crossing rate signal. The differentiation unit 120 comprises a smoothing filter 310 and a differentiator 320. The smoothing filter 310 is coupled to receive the zero-crossing rate signal from the zero-crossing rate calculator 110. Also the smoothing filter 310 is coupled to the differentiator 320. The differentiator has an output which is coupled to the discriminator 130.

The smoothing filter 310 operates on the zero-crossing rate signal and produces a filtered zero-crossing rate signal. In the preferred embodiment of the invention, the smoothing filter is an N-tap median filter (N=3). The purpose of the median filter is to remove outlying values from the zero-crossing rate signal. This type of filtering (a) increases the smoothness of the zero-crossing rate signal when the input signal has a constant spectrum (as occurs for tonal sequences), and (b) leaves the zero-crossing rate signal relatively unchanged when the input signal is speech—since speech has a dynamic spectrum.

The filtered zero-crossing rate signal is provided to the differentiator 320. The differentiator 320 performs a differentiation operation on the filtered zero-crossing rate signal producing a differentiated zero-crossing rate signal. In the preferred embodiment of the invention, the differentiator performs a first difference for the sake of computational efficiency. However in alternate embodiments, any numerical differentiation algorithm may be employed, subject to fundamental design constraints for computational efficiency and accuracy.

Figure 4:
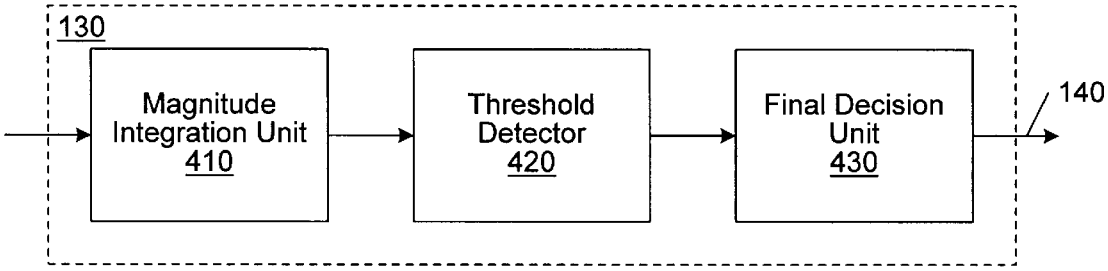
FIG. 4 is a block diagram of the discriminator 130 according to the present invention.

Referring now to FIG. 4, a block diagram of the discriminator 130 according to the present invention is shown. The discriminator 130 uses the differentiated zero-crossing rate signal to determine the instantaneous presence or absence of speech in the input signal. An output signal, reflecting the instantaneous presence or absence of speech in the input signal, is provided by discriminator 130 via output 140. The discriminator 130 includes a magnitude integration unit 410, a threshold detector 420, and final decision unit 430. The magnitude integration unit 410 is coupled to receive the differentiated zero-crossing rate signal from the differentiation unit 120. Also the magnitude integration unit 410 is coupled to the threshold detector 420. The threshold detector 420 is coupled to the final decision unit 430, and the final decision unit 430 provides is coupled to output 140.

The magnitude integration unit 410 performs a short-time magnitude integration on the differentiated zero-crossing rate signal. Thus, each output value from the magnitude integration unit 410 is computed by integrating the absolute value of the differentiated zero-crossing rate signal over a corresponding window (of length P samples). In the preferred embodiment of the invention, the integral is performed using the "leaky integrator" given by the transfer function $$H(z) = \frac{1-\alpha}{z-\alpha}.$$

In other words, if y(n) represents the value of an integral as it accumulates through the sample window, and x(n) represents the differentiated zero-crossing rate signal, the leaky integration is governed by the recurrence relation $$y(n+1)=a\cdot y(n)+(1-a)\cdot|x(n)|.$$

At the beginning of the sample window, the cumulative integral y(n) is initialized to zero. Then the recursive expression above is applied for every sample x(n) in the P-sample window. At the end of the sample window, the resultant value of the accumulated integral is reported as the output value. The cumulative integral y(n) is then re-initialized to zero for the next sample window integration. The output of the magnitude integration unit 410, referred to as the detection signal, is fed to the threshold detector 420.

In an alternate embodiment of the invention, the integration over a sample window referred to above is performed by an FIR filter. In this case, the output value is a weighted average of the absolute values of the samples in the sample window.

In yet another embodiment of the invention, the absolute value mentioned above is replaced by a square. In this case the output values comprise energy measurements.

The threshold detector 420 compares the resultant (integration) values comprising the detection signal to a fixed detection threshold R, and generates a sequence of decision values. If a resultant value exceeds the threshold R, the corresponding decision value is assigned a symbol which indicates the presence of speech. If the resultant value does not exceed the threshold R, the corresponding decision value is assigned a symbol which indicates the absence of speech. In the preferred embodiment, the detection threshold R takes the value 7.0. The sequence of decision values is referred to as a decision signal. The decision signal is supplied to the final decision unit 430.

The final decision unit 430 uses the decision signal to produce a sequence of final decision values. To calculate the final decision values, the final decision unit 430 employs a moving window of K successive decision values from the decision signal. Namely, a final decision value is calculated by counting a number of the K successive decision values which indicate the absence of speech. If the resultant number is larger than a first threshold J, then the final decision value is assigned a symbol indicating the absence of speech. If the resultant number is less than a second threshold I, then the final decision value is assigned a symbol indicating the presence of speech. The integers I and J are system defined constants with I less than or equal to J. The use of two distinct thresholds adds some hysteresis to the final decision process and aids in the prevention of spurious changes. The sequence of final decision values is referred to as a final decision signal. The final decision signal is asserted as the output of the final decision unit 430 via output 140.

In the preferred embodiment of the invention, the speech signal detector 100 operates as part of a telephone answering device. In this case it is important to detect the termination of the speech message so as to conserve storage space in the memory media which stores the speech message. However it essential that the answering machine capture the whole speech message. Thus the speech signal detector 100 must guard against premature/false detection of the end of the speech message. Decreasing the value of the first threshold J increases the probability of detecting the absence of speech. However increasing the value of threshold J decreases the probability of false detection of the absence of speech. The value of J must be chosen to balance these competing requirements. In the preferred embodiment, K is chosen to equal 20, J is chosen to equal 16, and I chosen to equal 14.

Figure 5:
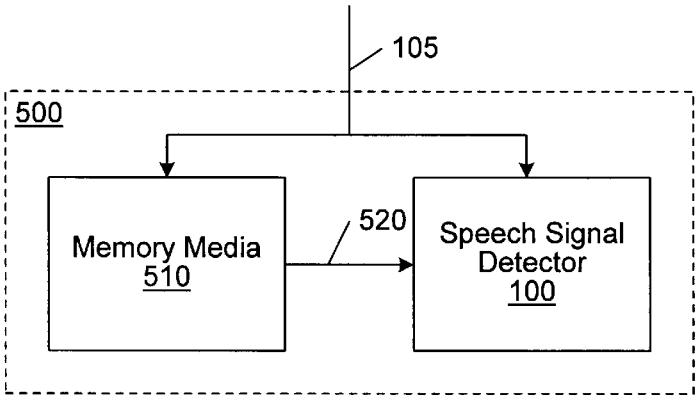
FIG. 5 is a speech storage device 500 according to the present invention.

Referring now to FIG. 5, a speech storage device 500 according to the present invention is shown. The speech storage device 500 comprises an input 105, speech signal detector 100 (of FIG. 1), memory media 510, and control line 520. The input 105 is coupled to the speech signal detector 100 and to memory media 510. The speech signal detector 100 is coupled to the memory media 510 via control line 520. An input signal is supplied to the speech storage device via input 105. It is assumed that at least a portion of the input signal contains a speech signal. The memory media 510 is operable to store the input signal. The speech signal detector 100 is operable to detect the initiation/termination of the speech signal within the input signal as described above. The control line 520 is identical to the output 140 (of FIG. 1) of the speech signal detector 100. The speech signal detector 100 provides an output signal via control line 420 indicating initiation/termination of the speech signal, and the output signal is used to control the storage of the input signal into the memory media 510. In particular, storage is enabled when the output signal indicates initiation of the speech signal, and disables storage when the output signal indicates termination of the speech signal.

Figure 6:
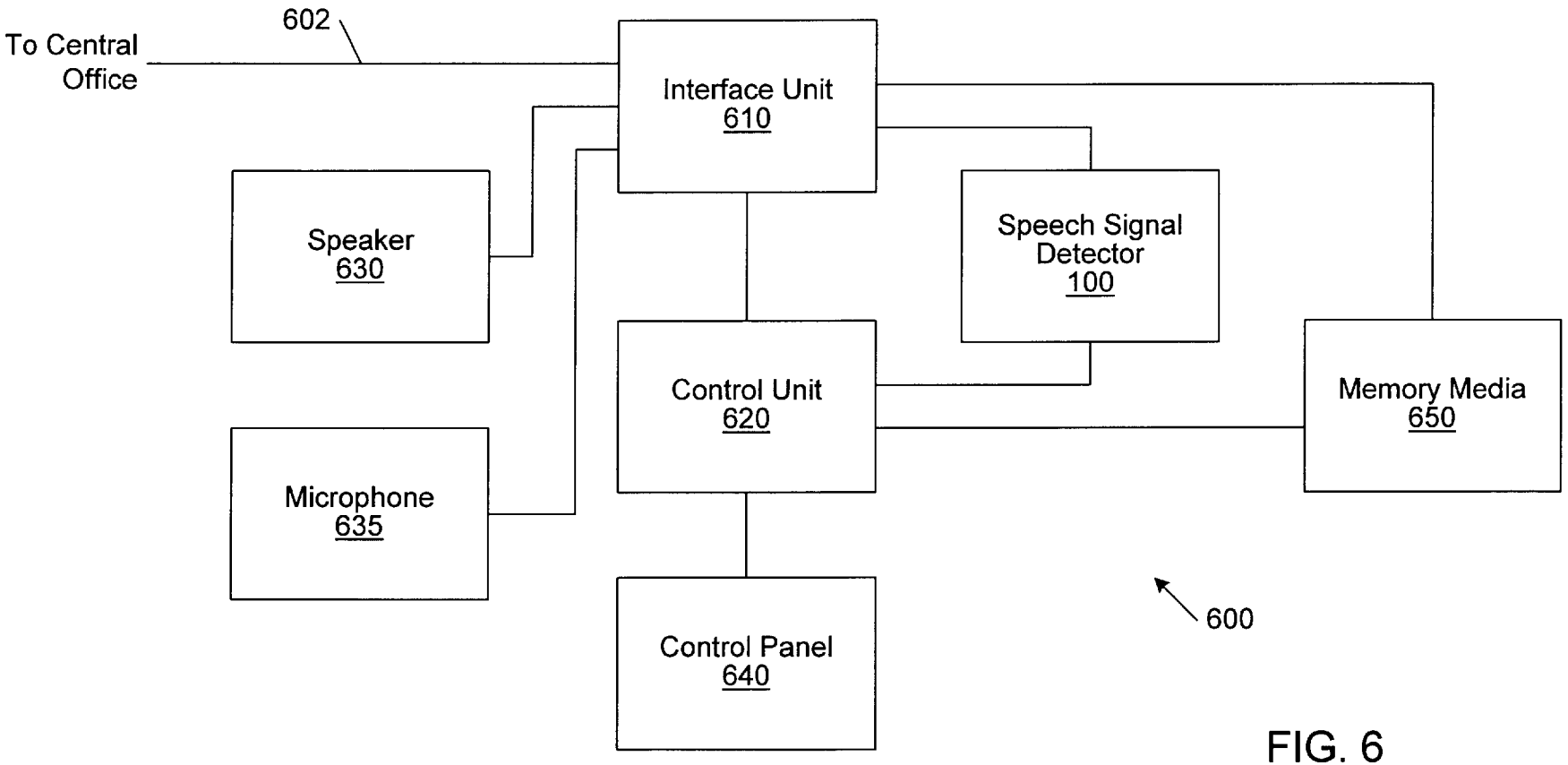
FIG. 6 is a block diagram of a telephone answering device 600 according to the present invention.

Referring now to FIG. 6, a block diagram of a telephone answering device 600 according to the present invention is shown. The telephone answering device 600 comprises an interface unit 610, a control unit 620, a speaker 630, a microphone 635, a control panel 640, speech signal detector 100, and memory media 650. The interface unit 610 is coupled to a central office of an external telephone system via a telephone line 602. Interface unit 610 is coupled to control unit 620, speech signal detector 100 (as illustrated in FIG. 1, and described in detail above), speaker 630, microphone 635, and memory media 650. Control unit 620 is coupled to control panel 640. It is noted that control panel 640 may comprise a graphical user interface (GUI) of a computer system (not shown). Control unit 620 is also coupled to speech signal detector 100 and memory media 650.

If a user of telephone answering device 600 does not answer an incoming telephone call within a predetermined number of ring signals, telephone answering device 600 "answers" the incoming telephone call. Answering the telephone call includes the telephone answering device 600 simulating an "off-hook" condition. Telephone answering device 600 then transmits a pre-recorded outgoing voice message over telephone line 602. Telephone answering device 600 then stores a calling party's audible response (i.e., an incoming voice message) into memory media 650.

Speech signal detector 100 receives a digitized telephone signal from interface unit 610, and provides to control unit 620 a control signal which indicates the termination of the speech message (in the telephone signal input). The telephone answering device 600 disables storage when the control signal indicates termination of the speech message.

Figure 7:
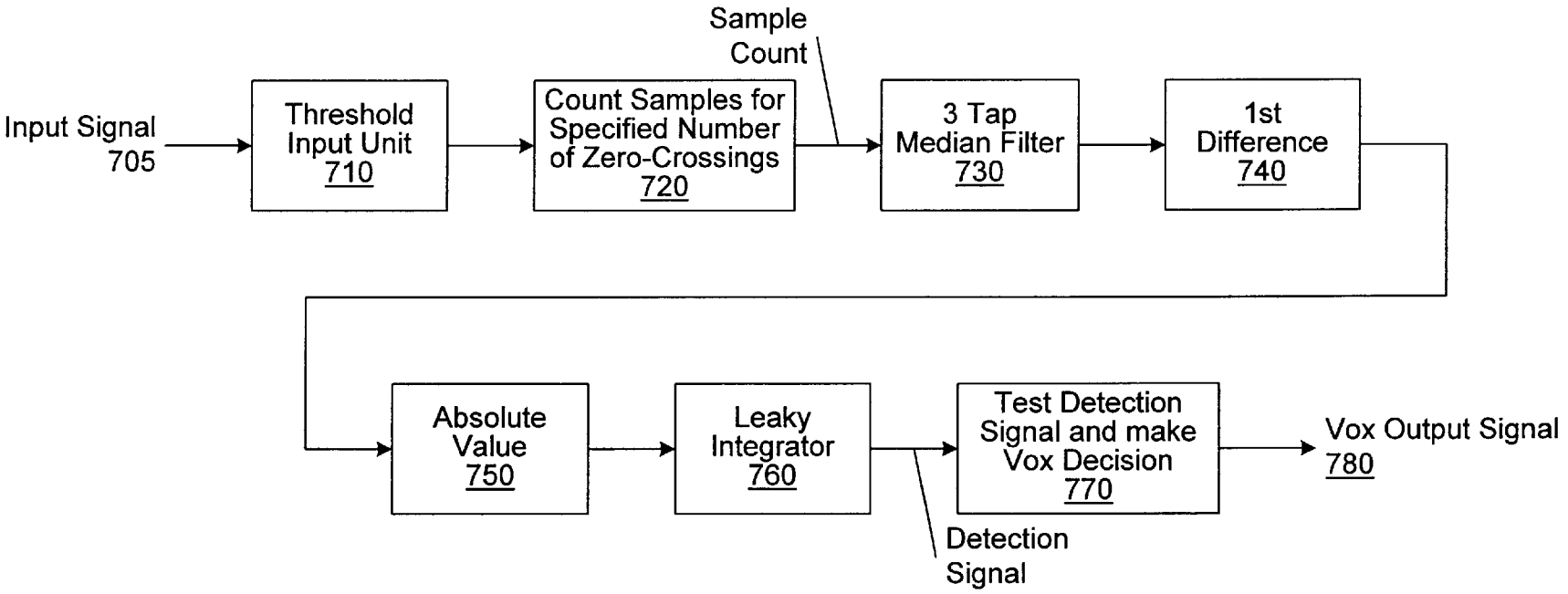
FIG. 7 is a block diagram of a preferred embodiment of the speech signal detector 100 according to the present invention.

Referring now to FIG. 7, a block diagram of a preferred embodiment of the speech signal detector 100 according to the present invention is presented. In this embodiment, the speech signal detector 100 comprises: a threshold input unit 710; a functional block 720 which counts the number of samples for achieving a specified number of zero-crossings; a 3-tap median filter 730; a first difference operation 740; an absolute value calculation 750; a leaky integrator 760; and a block 770 which tests the detection signal and makes the vox (voice activity) decision.

Threshold input unit 710 is identical to false crossing pre-filter 210 of FIG. 2. The function block 720, which counts the number of samples for achieving a specified number of zero-crossings, is identical to zero-crossing rate measurement unit 220 of FIG. 2. The 3-tap median filter 730 is a realization of the smoothing filter 310 of FIG. 3. The first difference operation 740 is a realization of differentiator 320 of FIG. 3. The absolute value calculation 750 and the leaky integrator 760 are together equivalent to the magnitude integration unit 410 of FIG. 4. The block 770, which tests the detection signal and makes the vox (voice activity) decision, is equivalent to a combination of the threshold detector 420 and the final decision unit 430 of FIG. 4.

Although the system and method of the present invention has been described in connection with the preferred embodiment, it is not intended to be limited to the specific forms set forth herein, but on the contrary, it is intended to cover such alternatives, modifications, and equivalents, as can be reasonably included within the spirit and scope of the invention as defined by the appended claims.

I claim:

1. A system for detecting initiation/termination of a speech signal for a speech storage device, the system comprising:

an input for receiving an input signal, wherein at least a portion of said input signal includes a speech signal;

a zero-crossing rate calculator coupled to said input for computing a zero-crossing rate signal based upon said input signal;

a differentiation unit coupled to said zero-crossing rate calculator which receives said zero-crossing rate signal from said zero-crossing rate calculator, wherein the differentiation unit is configured to perform a differentiation operation with respect to time to produce a differentiated zero-crossing rate signal;

a discriminator coupled to said differentiation unit which receives said differentiated zero-crossing rate signal, wherein said discriminator comprises a magnitude integration unit which is configured to integrate an absolute value of said differentiated zero-crossing rate signal to generate a series of resultant values, wherein said discriminator determines initiation/termination of said speech signal within said input signal based on the series of resultant values;

wherein said discriminator generates an output signal indicating initiation/termination of said speech signal within said input signal, wherein said output signal is used to control storage of said speech signal.

2. The system of claim 1, wherein said differentiation unit includes a smoothing filter, wherein said smoothing filter smoothes said zero-crossing rate signal and thereby produces a filtered zero-crossing rate signal, wherein said differentiation unit performs said differentiation operation with respect to time on said filtered zero-crossing rate signal to produce the differentiated zero-crossing rate signal.

3. The system of claim 2, wherein said smoothing filter comprises a median filter.

4. The system of claim 2, wherein said differentiation unit calculates a first difference on said filtered zero-crossing rate signal to produce said differentiated zero-crossing rate signal.

5. The system of claim 1, wherein the input signal comprises a sequence of input samples, wherein said zero-crossing rate calculator includes a false-crossing pre-filter, wherein said false-crossing pre-filter modifies the input signal by assigning a zero value to an input sample if the absolute value of the input sample is below a pre-determined threshold, wherein said false-crossing pre-filter produces a modified input signal, wherein said zero-crossing rate signal is computed based on said modified input signal.

6. The system of claim 1, wherein the input signal comprises a sequence of input samples, wherein said zero-crossing rate calculator generates a sequence of sample counts, wherein each sample count of said sequence of sample counts represents the number of said input samples required for the occurrence of L successive zero-crossings in said input signal, wherein L is a pre-defined positive integer, wherein said sequence of sample counts comprises said zero-crossing rate signal.

7. The system of claim 1, wherein the input signal comprises a sequence of input samples, wherein said zero-crossing rate calculator generates a sequence of zero-crossing counts, wherein each zero-crossing count of said sequence of zero-crossing counts represents the number of zero-crossings occurring in M successive samples of said input signal, wherein M is a pre-defined positive integer, wherein said sequence of zero-crossing counts comprises said zero-crossing rate signal.

8. The system of claim 1, wherein said magnitude integration unit is configured to calculate each resultant value of said series of resultant values by integrating absolute values of P consecutive samples of said differentiated zero-crossing rate signal, wherein P is a system specified integer constant, wherein said series of resultant values comprises a detection signal;

wherein said discriminator further comprises a threshold detector coupled to said magnitude integration unit, wherein said threshold detector compares said resultant values comprising said detection signal with a threshold value, and generates a sequence of first decision values, wherein a first decision value indicates the presence of said speech signal if a respective resultant value exceeds said threshold, and wherein the first decision value indicates the absence of said speech signal if the respective resultant value does not exceed said threshold, wherein said sequence of first decision values comprises a first decision signal.

9. The system of claim 8, wherein said discriminator operates on said first decision signal to produce a second decision signal, wherein said second decision signal comprises a sequence of second decision values, wherein a second decision value is determined using K successive values of said first decision signal, wherein K is a pre-defined integer constant, wherein said discriminator determines a number of said K successive values which indicate presence of said speech signal, and uses said number to determine said second decision value, wherein said second decision value indicates either presence or absence of said speech signal, wherein said second decision signal comprises said output signal of said discriminator.

10. The system of claim 1, wherein said system is comprised in a speech storage device, wherein said speech storage device receives and stores said input signal;

wherein said speech storage device receives from said discriminator said output signal indicating initiation/termination of said speech signal within said input signal, and uses said output signal to control storage of said input signal, wherein said speech storage device disables storage of said input signal when said output signal indicates termination of said speech signal, and enables storage of said input signal when said output signal indicates initiation of said speech signal.

11. A method for detecting initiation/termination of a speech signal for a speech storage device, the method comprising:

receiving an input signal, wherein at least a portion of said input signal includes a speech signal;

calculating a zero-crossing rate signal based on said input signal;

performing a differentiation operation with respect to time to generate a differentiated zero-crossing rate signal;

integrate an absolute value of the differentiated zero-crossing rate signal in order to compute a series of resultant values;

determining initiation/termination of said speech signal based on said series of resultant values, wherein said determining initiation/termination of said speech signal includes generating a control signal which indicates initiation/termination of said speech signal;

wherein said control signal is used to control storage of said speech signal.

12. The method of claim 11, wherein said performing a differentiation operation comprises:

smoothing said zero-crossing rate signal and thereby producing a filtered zero-crossing rate signal;

differentiating said filtered zero-crossing rate signal with respect to time in order to generate the differentiated zero-crossing rate signal.

13. The method of claim 12, wherein said smoothing said zero-crossing rate signal comprises applying a median filter algorithm to said zero-crossing rate signal.

14. The method of claim 12, wherein said differentiating said filtered zero-crossing rate signal with respect to time comprises performing a first difference on said filtered zero-crossing rate signal.

15. The method of claim 11, wherein said input signal comprises a sequence of input samples, wherein said calculating a zero-crossing rate signal based on said input signal includes:

modifying said input signal by assigning a zero value to an input sample if the absolute value of the input sample is below a pre-determined threshold, wherein said modifying produces a modified input signal;

wherein said zero-crossing rate signal is based on said modified input signal.

16. The method of claim 11, wherein the input signal comprises a sequence of input samples, wherein said calculating a zero-crossing rate signal comprises generating a sequence of sample counts, wherein each sample count of said sequence of sample counts represents the number of said input samples required for the occurrence of L successive zero-crossings in said input signal, wherein L is a pre-defined positive integer, wherein said sequence of sample counts comprises said zero-crossing rate signal.

17. The method of claim 11, wherein the input signal comprises a sequence of input samples, wherein said calculating a zero-crossing rate signal comprises generating a sequence of zero-crossing counts, wherein each zero-crossing count of said sequence of zero-crossing counts represents the number of zero-crossings occurring in M successive input samples of said input signal, wherein said sequence of zero-crossing counts comprises said zero-crossing rate signal.

18. The method of claim 11, wherein said integrating the absolute value of the zero-crossing rate signal comprises computing each of the resultant values by integrating P consecutive samples of said differentiated zero-crossing rate signal, wherein P is a system specified integer constant, wherein said series of resultant values comprises a detection signal;

wherein said determining initiation/termination of said speech signal based on said series of result values comprises comparing said resultant values comprising said detection signal with a threshold value, and generating a sequence of first decision values, wherein a first decision value indicates the presence of said speech signal if a respective resultant value exceeds said threshold, and wherein the first decision value indicates the absence of said speech signal if the respective value does not exceed said threshold, wherein said sequence of first decision values comprises a first decision signal.

19. The method of claim 18, wherein said determining initiation/termination of said speech signal based on said differentiated zero-crossing rate signal further comprises:

producing a sequence of second decision values using said first decision signal, wherein each second decision value is produced using a corresponding window of K successive first decision values from said first decision signal, wherein K is a pre-defined integer constant, wherein producing a second decision value comprises:

determining a number of said K successive values which indicate presence of said speech signal; and using said number to determine said second decision value, wherein said second decision value indicates either presence or absence of said speech signal;

wherein said second decision signal comprises said control signal.

20. The method of claim 11, wherein said method operates in a speech storage device, the method further comprising:

storing said input signal in response to said control signal indicating initiation of said speech signal;

discontinuing said storing said input signal in response to said control signal indicating termination of said speech signal.

21. A system for detecting termination of a speech message for a speech storage device, the system comprising:

an input for receiving an input signal, wherein at least a portion of said input signal includes a speech message signal;

a zero-crossing rate calculator coupled to said input for computing a zero-crossing rate signal based upon said input signal;

a differentiation unit coupled to said zero-crossing rate calculator which receives said zero-crossing rate signal from said zero-crossing rate calculator, wherein the differentiation unit is configured to perform a differentiation operation with respect to time to produce a differentiated zero-crossing rate sign;

a discriminator coupled to said differentiation unit which receives said differentiated zero-crossing rate signal, wherein said discriminator comprises a magnitude integration unit which is configured to integrate an absolute value of said differentiated zero-crossing rate signal to generate a series of resultant values, wherein said discriminator determines termination of said speech message signal within said input signal based on the series of resultant values;

wherein said discriminator generates an output signal indicating termination of said speech message signal, wherein said output signal is used to control storage of said speech message signal.

22. A telephone answering device comprising:

an input for receiving an input signal, wherein at least a portion of said input signal includes a speech message signal;

a memory media which receives and stores said input signal;

a message-termination detector coupled to said input, and operable to determine termination of said speech message signal within said input signal, wherein said message-termination detector generates a control signal indicating termination of said speech message signal;

wherein said telephone answering device discontinues storage of said input signal in said memory media in response to said control signal indicating termination of said speech message signal;

wherein said message-termination detector comprises:

a zero-crossing rate calculator coupled to said input for computing a zero-crossing rate signal based upon said input signal;

a differentiation unit coupled to said zero-crossing rate calculator which receives said zero-crossing rate signal from said zero-crossing rate calculator, wherein the differentiation unit is configured to perform a differentiation operation with respect to time to produce a differentiated zero-crossing rate signal;

a discriminator coupled to said differentiation unit which receives said differentiated zero-crossing rate signal, wherein said discriminator comprises a magnitude integration unit which is configured to integrate an absolute value of said differentiated zero-crossing rate signal to generate a series of resultant values, wherein said discriminator determines termination of said speech message signal within said input signal based on the series of resultant values.

* * * * *

UNITED STATES PATENT AND TRADEMARK OFFICE

CERTIFICATE OF CORRECTION

PATENT NO. : 5,970,447

DATED : October 19, 1999

INVENTOR(S) : Mark A. Ireton

It is certified that error appears in the above-identified patent and that said Letters Patent is hereby corrected as shown below:

On the title page, item [54]

should be SYSTEM AND METHOD FOR DETECTING VOICE ACTIVITY BASED ON INTEGRATED ABSOLUTE VALUES OF THE DIFFERENTIATED ZERO CROSSING RATE.

Signed and Sealed this

Second Day of May, 2000

*Attest:*

Q. TODD DICKINSON

*Attesting Officer*

*Director of Patents and Trademarks*